US005770272A

United States Patent [19]

Biemann et al.

[11] Patent Number: 5,770,272

[45] Date of Patent: Jun. 23, 1998

[54] MATRIX-BEARING TARGETS FOR MALDI MASS SPECTROMETRY AND METHODS OF PRODUCTION THEREOF

[75] Inventors: Klaus Biemann, Alton Bay, N.H.; Heinrich Köchling, Allston, Mass.

[73] Assignee: Massachusetts Institute of Technology, Cambridge, Mass.

[21] Appl. No.: 431,064

[22] Filed: Apr. 28, 1995

[51] Int. Cl.[6] ..... B05D 1/02

[52] U.S. Cl. ..... 427/421; 427/424

[58] Field of Search ..... 427/421, 424, 427/422; 250/288

[56] References Cited

U.S. PATENT DOCUMENTS

| | | | |
|---|---|---|---|
| 4,106,697 | 8/1978 | Sickles et al. | 239/15 |
| 4,392,617 | 7/1983 | Bakos et al. . | |
| 4,823,009 | 4/1989 | Biemann et al. . | |
| 4,843,243 | 6/1989 | Biemann et al. . | |
| 5,045,694 | 9/1991 | Beavis et al. . | |
| 5,118,937 | 6/1992 | Hillenkamp et al. . | |
| 5,281,538 | 1/1994 | Cottrell et al. . | |
| 5,308,978 | 5/1994 | Cottrell et al. | 250/288 |
| 5,382,793 | 1/1995 | Weinberger et al. . | |
| 5,453,247 | 9/1995 | Beavis et al. . | |
| 5,607,859 | 3/1997 | Biemann et al. . | |

FOREIGN PATENT DOCUMENTS

PCT/US96/05796 10/1996 WIPO .

OTHER PUBLICATIONS

Hillenkamp, F. and M. Karas, Methods in Enzymology, vol. 193, 280–295 (1990) no month.

Hutchens, T.W. and T.T. Yip, Rapid Communications in Mass Spectrometry, vol. 7, 576–580 (1993) no month.

Perera, I. et al., Rapid Communications in Mass Spectrometry, vol. 9, 180–187 (1995) no month.

Vorm, O. et al., Anal. Chem. 66:3281–3287 (1994) no month.

Xiang, F. and R. C. Beavis, Rapid Communications in Mass Spectrometry, vol. 8, 199–204 (1994) no month.

LC–Transform System Instruction Manual, Lab Connections, Inc., Marlborough, MA (1991) no month.

*Primary Examiner*—Shrive Beck
*Assistant Examiner*—Bret Chen
*Attorney, Agent, or Firm*—Wolf, Greenfield & Sacks, P.C.

[57] ABSTRACT

The present invention provides new methods for producing substantially continuous, homogeneous layers of MALDI matrix materials deposited on MALDI targets and substantially free of voids and large crystals. The methods involve the deposition of MALDI matrix materials in a nebulized spray which is enveloped in a sheath of non-reactive gas which confines and entrains the spray and aids in the evaporation of the solvent such that substantial, if not complete, solvent evaporation occurs before the matrix material is deposited on the target surface. The invention further provides such matrix layers and pre-formed matrix-bearing targets for use in MALDI mass spectrometry.

5 Claims, 1 Drawing Sheet

MATRIX-BEARING TARGETS FOR MALDI MASS SPECTROMETRY AND METHODS OF PRODUCTION THEREOF

FIELD OF THE INVENTION

The present invention relates to the field of mass spectrometry and more particularly to the field of matrix-assisted laser desorption/ionization mass spectrometry and the preparation of matrix layers therefor.

BACKGROUND OF THE INVENTION

Matrix-assisted laser desorption/ionization ("MALDI") mass spectrometry provides for the spectrometric determination of the mass of poorly ionizing or easily fragmented analytes of low volatility by embedding them in a matrix of light-absorbing material. The matrix material, which is present in large excess relative to the analyte, serves to absorb energy from the laser pulse and to transform it into thermal and excitation energy to desorb and ionize the analyte. This technique was introduced in 1988 by Hillenkamp and Karas (Karas, M. and Hillenkamp, F. (1988). *Anal. Chem.* 60:2299) for use with large biomolecules. Since then, the art of MALDI mass spectrometry has advanced rapidly and has found applications in the mass determination of molecules ranging from small peptides, oligosaccharides and oligonucleotides to large proteins and synthetic polymers.

The standard approach for MALDI sample preparation has been to deposit a dilute solution of analyte and a highly concentrated solution of matrix material on a substrate. The analyte and matrix solutions may be thoroughly mixed before deposition (see, e.g., Beavis, R. C. and Chait, B. T. (1990). Anal. Chem. 62:1836) or may be deposited separately and mixed on the substrate (see, e.g., Karas, M. and Hillenkamp, F. (1988). *Anal. Chem.* 60:2299; Salehpour, M., Perera, I. K., Kjellberg, J., Hedin, A., Islamian, M., Hakansson, P., and Sundqvist, B.U.R. (1989). *Rapid Commun. Mass Spectrom.* 3:259). The sample drop is then allowed to dry on the probe tip or target.

In this "dried-drop" technique, relatively large crystals of matrix and analyte form at random seed points, often at the perimeter of the drop, as the solvent evaporates. For the standard MALDI matrix materials, these crystals have a size range of about ~5–150 $\mu$m (Perera, I. K., Perkins, J. and Kantartzoglou, S. (1995). Rapid. Commun. Mass Spectrom. 9:180–187). Because the crystals do not form a continuous, homogeneous layer on the substrate, and because both the crystals and the spaces or "voids" between them may be on the same scale as the diameter of the laser beam employed, two problems arise: (1) if the laser beam is randomly targeted at the sample, there is great variance in the spectra obtained from different areas of the sample because of the heterogeneity of the matrix/analyte distribution and (2) in systems with microscopic in situ observation of the target, it is necessary for the operator to find and target "good spots" at which a matrix crystal incorporating the analyte has formed. In addition, because much of the deposited analyte may not become embedded in such a non-homogenous array of scattered matrix crystals, much of the deposited analyte may be wasted and the sensitivity of the technique is thereby diminished.

Numerous attempts have been made in the recent past to produce more homogeneous samples for MALDI mass spectrometry. For example, drops of matrix and analyte have been subjected to a vacuum to accelerate drying and, presumably, to produce smaller and more homogeneous crystals (Weinberg, S. R., Boernson, K. O., Finchy, J. W., Robertson, V., Musselman, B. D. (1993) Proc. 41st ASMS Conf. Mass Spectrom. Allied Topics, San Francisco, p. 775). Xiang and Beavis report a method in which they produce a matrix layer by standard dried-drop deposition, physically crush this layer under a glass slide to break up larger crystals, and then deposit a second drop of matrix and analyte solution on this crushed layer (Xiang, F. and Beavis, R. C. (1994) *Rapid Commun. Mass Spectrom.* 8:199–204). Perera, et al. attempted to produce improved MALDI samples by "spin-coating" solutions of matrix and analyte onto a target rotating at 300–500 rpm (Perera, I. K., Perkins, J. and Kantartzoglou, S. (1995). *Rapid. Commun. Mass Spectrom.* 9:180–187). Finally, Vorm, et al. have attempted to produce improved matrix layers on MALDI targets by using a highly volatile solvent, acetone, which evaporates so rapidly that large crystals cannot form (Vorm, O. Roepstorff, P. and Mann, M. (1994). *Anal. Chem.* 66:3281–3287).

These attempts have met with varying success but, in general, still suffer from one or more of several problems: (1) they produce a discontinuous layer of crystals separated by bare spots or "voids" either in which there is no matrix layer present at all or in which the matrix layer is so thin that no appreciable signal may be gained, (2) they produce more homogeneous but thin layers in which the low density of the matrix material limits the amount of analyte which can be embedded in the matrix and the signal which can be generated by a given laser pulse, and/or (3) they are useful only with certain matrix materials which are soluble in high-volatility solvents.

SUMMARY OF THE INVENTION

The present invention provides new methods for depositing MALDI matrix material layers on targets for use in MALDI mass spectrometry. The methods include directing at a deposition surface a nebulized spray of a solution of a MALDI matrix material dissolved in a solvent while simultaneously directing at the surface a stream of non-reactive gas which forms a substantially coaxial sheath enveloping the spray. The spray of matrix and solvent is confined and entrained by the sheath gas, and the sheath gas aids in the evaporation of the solvent from the spray. The substrate surface and the spray move relative to one another such that a continuous layer of the matrix material is deposited on the target.

In preferred embodiments, the matrix material is selected from the group consisting of sinapinic acid, $\alpha$-cyano-4-hydroxycinnamic acid, 2,5-dihydroxybenzoic acid, 3-hydroxypicolinic acid, 5-(trifluoro-methyl)uracil, caffeic acid, succinic acid, anthranilic acid, 3-aminopyrazine-2-carboxylic acid, ferulic acid, 7-amino-4-methyl-coumarin, 2,4,6-trihydroxy acetophenone, and 2-(4-hydroxyphenylazo)-benzoic acid 7-amino-4-methyl-coumarin, 2,4,6-trihydroxy acetophenone, and 2-(4-hydroxyphenylazo)-benzoic acid.

In other preferred embodiments, including those listed above, the non-reactive gas is selected from the group consisting of $N_2$, the noble gases, and dried air.

In preferred embodiments, including those listed above, the spray exits a needle tip having at least one interior dimension in the range of 0.2–0.8 mm, the solution has a flow rate in the range of 10–70 $\mu$L/min, the nebulizer gas has a flow rate in the range of 20–60 $\mu$L/min, and the sheath gas has a flow rate in the range of 1–10 L/min.

In other preferred embodiments, including those listed above, the non-reactive sheath gas is heated relative to the solution to aid in the evaporation of the solvent. For high-volatility solvents, the heating is preferably in the range of 25°–40° C. whereas for low-volatility solvents the heating is preferably in the range of 60°–95° C.

As an additional step in each of the embodiments listed above, the matrix material may be allowed to crystallize on the target surface and then be lightly contacted with a soft, non-abrasive material to remove a layer of loose microcrystals which may be present.

The present invention also provides for matrix-bearing targets for use in MALDI mass spectrometry. These targets include a substrate which defines a deposition surface and a continuous matrix layer of a MALDI matrix material non-covalently bound to the substrate. These matrix layers have an area of at least 10,000 $\mu m^2$, an average thickness in excess of 0.7 $\mu$m, and are substantially free of matrix material crystals having any dimension in excess of 10 $\mu$m.

In preferred embodiments, the matrix material is selected from the group consisting of sinapinic acid, α-cyano-4-hydroxycinnamic acid, 2,5-dihydroxybenzoic acid, 3-hydroxypicolinic acid, 5-(trifluoro-methyl)uracil, caffeic acid, succinic acid, anthranilic acid, 3-aminopyrazine-2-carboxylic acid, ferulic acid, 7-amino-4-methyl-coumarin, 2,4,6-trihydroxy acetophenone, and 2-(4-hydroxyphenylazo)-benzoic acid.

In addition, in preferred embodiments including those listed above, the matrix material is soluble in a low-volatility solvent.

In preferred embodiments, including those listed above, the deposition surface comprises a conductive metal and, preferably, a metal selected from the group consisting of gold, silver, chrome, nickel, aluminum, copper, and stainless steel.

In additional embodiments, including those listed above, the target also includes an adhesive material bonded to a surface opposite and parallel to the deposition surface.

In additional embodiments, including those listed above, the target has a thickness, measured from the deposition surface to an opposite and substantially parallel surface, of less than 2 millimeters, less than 1 millimeter and, most preferably, less than 0.5 mm.

In other embodiments, including those listed above, the target may be composed of more than one layer. The top layer forms the deposition surface and is bonded to the base layers. In preferred embodiments, the deposition layer may be formed from a metallic foil or may be die-cut from a sheet metal.

In preferred embodiments, including those listed above, the matrix layer has an area of at least 1 $mm^2$, at least 10 $mm^2$, or at least 100 $mm^2$.

In additional preferred embodiments, including those listed above, the matrix layer is substantially free of matrix material crystals having any dimension in excess of 5 $\mu$m.

In further preferred embodiments, including those listed above, the matrix layer has an average thickness in excess of 10 $\mu$m or in excess of 20 $\mu$m.

DETAILED DESCRIPTION OF THE INVENTION

Figure 1:
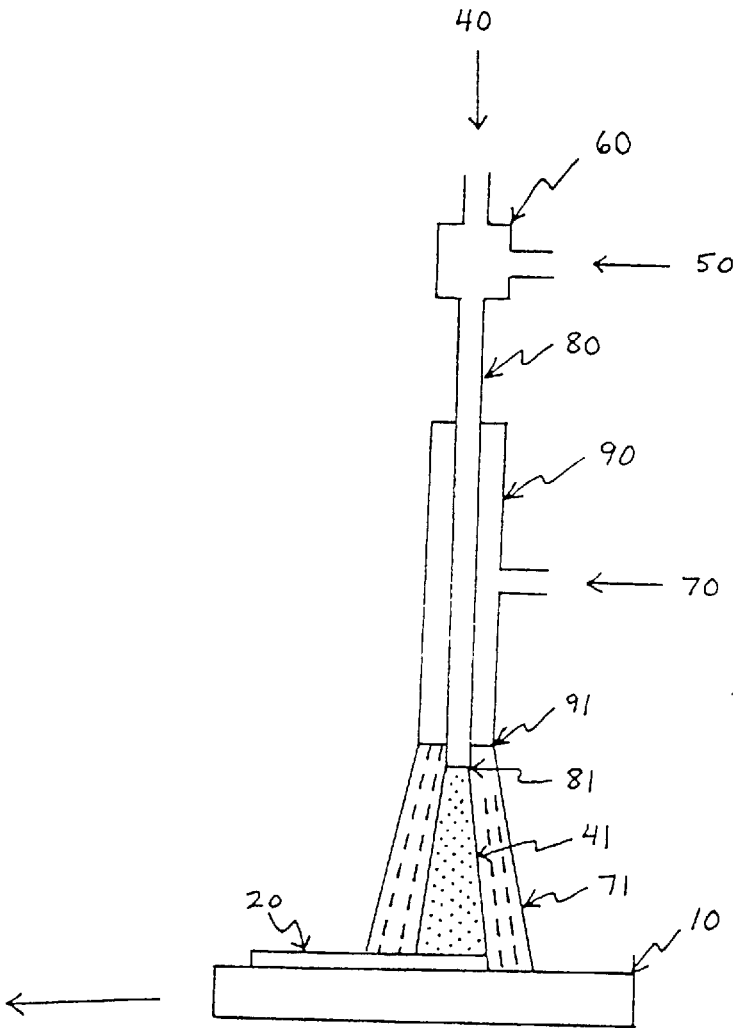
FIG. 1 is a schematic representation of the method of the present invention used to produce a matrix-bearing target for MALDI mass spectrometry.

The present invention provides new methods of depositing matrix layers for use in MALDI mass spectrometry and, thereby, also provides new products for use in MALDI which are the result of these methods. These new methods and products are described in detail separately below.

Methods of Depositing MALDI Matrices

In one aspect, the present invention provides new methods of depositing matrix layers for use in MALDI mass spectrometry. These methods depend in part upon the discovery that a substantially continuous, homogeneous layer of matrix material may be deposited upon a moving substrate by spraying a solution of matrix material and solvent from a nebulizer which simultaneously discharges a coaxial stream or sheath of gas around the spray. It has been discovered that the sheath of gas both confines or entrains the spray and aids in the partial evaporation of the solvent. It has further been discovered that substantial, if not complete, evaporation of the solvent and a fine spray of matrix material result in a continuous, homogeneous matrix layer substantially free of large (i.e., >5–10 $\mu$m) crystals of matrix material.

FIG. 1 illustrates the general method. A solution of matrix and solvent 40 and a nebulizer gas 50 enter a tee 60 where they mix. The solution and nebulizer gas exit the tee through a needle tube 80 to form a spray 41 of the nebulized solution at the needle tip 81. The needle tube may be positioned perpendicularly to the substrate or at an angle to the perpendicular. Preferably, the needle tube is perpendicular. The needle tube is at least partially surrounded by a hollow sheath tube 90 into which flows the sheath gas 70. At one end, the sheath tube forms a nozzle 91 which is in substantial proximity to the needle tip. The sheath gas exits the nozzle to form a coaxial envelope or sheath 71 of gas around the spray. A substrate 10 in close proximity to the needle tip moves relative to the needle tip such that the spray contacts the moving substrate and a continuous layer of matrix material 20 is deposited on the substrate. Although the figure and subsequent description of the invention suggest that the substrate moves relative to the needle tip, it should be understood throughout that the substrate may be fixed in position and that the needle tip may move relative to the substrate.

The equipment necessary to practice the present invention is shown schematically in FIG. 1 and is further described below. Currently, however, there are commercially available devices which can be used for at least some of the embodiments of the present invention. These devices, the Series 100 LC Transforms (Lab Connections, Inc., Marlborough, Mass.), were actually designed for the deposition of HPLC fractions and have additional capabilities not required to practice the present invention. In addition, they are adapted for depositing HPLC eluents rather than producing matrix-bearing MALDI targets. Nonetheless, with minor modifications to their intended method of use, they may also be used to produce the matrix-bearing MALDI targets of the present invention.

The matrix layers of the present invention are substantially continuous layers which are substantially free from microscopic "voids" or spots at which either the substrate is exposed through the matrix layer or the thickness of the deposited matrix material is <0.7 $\mu$m. That is, the matrix forms a continuous, homogeneous layer substantially free of any regions, even at the microscopic level, in which the deposition surface is not covered with a substantial layer of matrix material. The amount of matrix material deposited per unit area on the surface, referred to herein as the "density," varies somewhat depending upon the matrix material employed but is generally about 0.5 to 500 nanomoles/mm$^2$. More preferably, the density is between 5 and 50 nanomoles/mm$^2$ and, most preferably, the density is about 25 nanomoles/mm$^2$. Alternatively, the density may be expressed as about 1 to 100 $\mu$g/mm$^2$, more preferably about 1 to 10 $\mu$g/mm$^2$ and, most preferably, about 5 $\mu$g/mm$^2$. If the density of the matrix is too low, there will be insufficient matrix to embed the MALDI analytes and, upon loading an analyte sample, all of the matrix will be dissolved by the analyte's solvent. As a result, the redissolved matrix will dry much like the dried-drop matrix layers of the prior art and the advantages of the present invention will, at least in part, be lost. On the other hand, an excess of matrix will result in a "rough" and non-homogeneous layer with visible crystals poorly adhered to the substrate.

As will be apparent from FIG. 1 and the description above, several variables will affect the amount of matrix material deposited per unit area. Amongst these are (1) the diameter of the needle tip, (2) the flow rate of the matrix and solvent solution, (3) the concentration of the matrix material in the solution, (4) the distance between the needle tip and the deposition surface, and (5) the rate of movement of the substrate relative to the needle tip. These variables should be adjusted, as further described below, so that a layer of matrix of appropriate coverage is deposited on the substrate surface.

It should be noted that the same area of the substrate may be passed under the spray multiple times to build-up a thicker or denser layer of matrix material. Thus, the present method may include multiple passes of the spray over the substrate. Such multiple passes will affect the density of the layer in a straight-forward manner, increasing the density in approximate proportion to the number of passes.

In preferred embodiments, the needle tube of the present invention is substantially circular in cross-section. The needle tube may have a single, constant diameter or may be larger in diameter at the inlet end and smaller at the needle tip. The needle tip may be described by an inner diameter and an outer diameter. In preferred embodiments, the inner diameter is in the range of 0.2 to 0.8 mm and the outer diameter is in the range of 0.4 to 1.0 mm. In one preferred embodiment, the needle is a standard 22 gauge needle. A small inner diameter is believed necessary to subject the solution to shearing forces as it exits the needle tip and, thereby, to create a fine, substantially homogeneous spray.

In order to produce a wider "track" of matrix material on the substrate, multiple needles may be employed in parallel or a wider needle may be employed. As noted above, it is believed that the needle tip bore must be small (e.g. 0.2 to 0.8 mm) in at least one dimension to subject the solution to shearing forces and to create a fine, substantially homogeneous spray. This does not, however, preclude a needle tip which is wider in some other dimension. Thus, for example, a needle tip may be substantially rectangular or slot-shaped in cross-section with the longer sides being substantially perpendicular to the direction of movement of the substrate to produce a wider track. In such a case, the shorter sides (substantially parallel to the direction of movement) should be sufficiently small to create a fine spray while the longer sides may be several millimeters or even several centimeters in length to create a broad track. Such broad, flat needle tips may be particularly useful in mass production of matrix-bearing MALDI targets.

The sheath tube of the present invention surrounds at least a portion of the needle tube and, in particular, forms a nozzle which extends approximately to the end of the needle tip. The nozzle may extend somewhat beyond the needle tip, such that the needle tip is recessed within the nozzle, but this is not preferred. Rather, in preferred embodiments, the nozzle is either co-planar with the needle tip or, more preferably, the nozzle is somewhat recessed from the needle tip. Thus, for example, in a preferred embodiment, the nozzle is recessed between about 0.1 and 2 mm from the end of the needle tip and, most preferably, 0.5 mm.

The sheath tube is preferably of similar cross-sectional shape as the needle tube but, obviously, is larger so that it may surround the needle tube and so that sheath gas may flow between the inner surface of the sheath tube and the outer surface of the needle tube towards the nozzle. As with the needle tube, the sheath tube may be of constant cross-sectional area or may be larger toward the tee and smaller at the nozzle tip. In one set of embodiments, both the needle tip and the nozzle are substantially circular in cross-section and concentric. Thus, for example, the needle tip may have an outer diameter of 0.4 mm and the nozzle may have an inner diameter of 0.6 to 0.8 mm. As another example, the outer diameter of the needle tip may be 0.8 mm and the inner diameter of the nozzle may be 1.0 to 1.2 mm. In a preferred embodiment, the needle tip is a standard 22 gauge needle and the nozzle has an inner diameter of 0.8 mm.

The flow rate of the matrix and solvent solution is within experimental control and will affect the density of the matrix layer. This rate is, of course, constrained by the bore of the needle tip because this bore will limit the amount of fluid which can exit into the spray. Thus, absolute ranges for the flow rate cannot be specified independent of the needle tip bore. For a needle tip which is a standard 22 gauge needle, however, preferred solution flow rates have been found to be in the range of 10 to 70 $\mu$L/min and, most preferably, about 30 $\mu$L/min. Flow rates for correspondingly larger or smaller bores may be easily derived from these ranges. In addition, it should be obvious that the flow rate should, at a minimum, maintain a relatively continuous flow and not an intermittent or "pulsating" flow.

The concentration of the matrix material in the solution is another adjustable variable which will affect the density of the matrix layer deposited on the substrate. In the prior art methods, matrix solutions are often prepared by adding an excess of matrix material to a solvent to produce a saturated solution. In the present method, however, the use of solutions with very high concentrations of matrix material may result in matrix material precipitating out of the solution while still within the needle tube. This results in a clogging of the tube and an uneven or sputtering spray. To avoid this, lower concentrations of matrix material are generally preferred. Thus, for example, solutions at 75%, 50%, 33%, or 25% of saturation may be employed.

The needle tip of the present invention is positioned a relatively short, fixed distance from the substrate. Like the previously discussed variables, this distance will affect the density of the matrix material on the substrate because this distance will determine, in part, the degree of spreading of the spray from its exit at the needle tip until its contact with the deposition surface. If the needle tip is too close to the substrate, the track of matrix material deposited on the moving substrate surface will be little wider than the needle tip diameter. In addition, if the distance is too short, there will be little opportunity for the solvent to partially evaporate. On the other hand, as the distance becomes too great, the sheath of gas entraining or confining the spray will dissipate and/or too much of the solvent may evaporate. Preferably, the distance between the needle tip and the substrate is at least about 2 mm and less than about 15 mm. More preferably, the distance is in the range of 3.5 to 12.5 mm. The most preferred distance in the embodiments described herein has been found to be about 11.5 mm. For standard 22 gauge needle tips, and using the sheath gas as described herein, these distances resulted in matrix layer tracks approximately 3.0 to 6.0 mm in width.

In the method of the present invention, the substrate is moved relative to the needle tip as the spray is discharged (or, equivalently, the needle tip may be moved relative to the substrate). This movement, obviously, also affects the density of the matrix material deposited upon the substrate. Preferably, the movement of the substrate is in a plane perpendicular to the shortest distance between the needle tip and the substrate such that this distance does not change during the deposition of the matrix layer. The motion in this plane may be translational (producing a linear matrix layer), rotational (producing an annular matrix layer), or both (producing a spiral matrix layer). Preferably, the linear speed of the substrate relative to the needle is constant so that, all other variables held constant, the amount of spray per unit area of substrate is also constant. Alternatively, if the linear speed of the substrate relative to the needle tip varies over time (e.g. when depositing a spiral matrix on a substrate rotating and translating at fixed rates), the flow rate of the solution may be varied accordingly to maintain a constant amount of spray per unit area of substrate. As with the other variables discussed above, the speed of the substrate will affect the density of the matrix layer deposited on the substrate. Therefore, no absolute ranges of preferred rates may be specified independent of these variables. Nonetheless, for the ranges of needle tip diameters, flow rates, matrix concentrations, and needle tip distances described above, linear speeds of the substrate may vary between about 1 to 30 mm/min, more preferably may vary between 5 and 20 mm/min, and most preferably is about 10 mm/min.

The five variables discussed above have the greatest impact on the density of the matrix layer on the deposition surface. Appropriate densities are well known in the art but, as noted above, are generally about .0.5 to 500 nanomoles/$mm^2$. More preferably, the density is between 5 and 50 nanomoles/$mm^2$ and, most preferably, the density is about 25 nanomoles/$mm^2$. Alternatively, the density may be expressed as about 1 to 100 $\mu g/mm^2$, more preferably about 1 to 10 $\mu g/MM^2$ and, most preferably, about 5 $\mu g/mm^2$. Any and all of these factors may be varied in order to obtain a matrix layer of appropriate density. For obvious reasons, however, it is more convenient to alter some of these variables than others. Varying the needle diameter, for example, requires mechanical changes to the device used in the method. In addition, the needle tip dimension parallel to the direction of movement of the substrate is constrained to a relatively narrow range to ensure a fine spray of solution. Similarly, the distance between the needle tip and the substrate surface, although more easily changed, is preferably chosen to obtain a matrix track of a desired width and is not the best choice for altering the matrix density. Finally, because it is inconvenient to repeatedly mix and test matrix solutions of differing concentrations, this variable is best left fixed. The rate of movement of the substrate and the flow rate of the solution, on the other hand, can generally be altered simply by adjusting control knobs. Thus, these two variables are the preferred ones to be manipulated when adjusting the matrix density. In addition, as noted above, multiple passes of the spray may be used to increase the matrix density.

Measurements of the matrix density on the deposition surface can be obtained by any of several means well known in the art. The present inventors, however, have found several quick tests which provide an adequate determination or first approximation. First, the matrix layer should not be translucent but, rather, should appear as an opaque "film." A translucent layer indicates insufficient matrix deposition. Second, when viewed at an angle to a light source, the layer should not be iridescent or show an interference fringe. Such an interference fringe indicates that the thickness of the layer is less than the wavelengths of visible light (i.e. <0.7 $\mu$m), and, therefore, indicates insufficient matrix deposition. Third, the matrix layer should not appear "rough" when viewed with the naked eye and should not show spotting or have visible crystals on the surface. A rough, spotted, surface with visible crystals indicates an excess of matrix material. Fourth, a small drop (~1 $\mu$L) of water placed upon the matrix layer should not dissolve the entire thickness of the matrix such that the deposition surface is clearly seen below. Dissolution of the entire thickness of the matrix layer by such a drop of water indicates insufficient matrix. Fifth, viewing in an optical microscope (200–1000×) should reveal a substantially continuous matrix layer, substantially free of voids in which there is not a substantial (i.e. >0.7 $\mu$m) matrix layer. The presence of such voids indicates insufficient matrix material has been deposited.

The present inventors have noted that the matrix layers produced by the present invention may be of two general types. Some matrix materials (e.g. 2,5-dihydroxybenzoic acid) form a matrix layer which consists only of a well-adhered layer of microcrystals (i.e. ~1 $\mu$m) whereas other matrix materials (e.g. $\alpha$-cyano-4-hydroxycinnamic acid) form the same well-adhered microcrystalline layer but also form a powdery layer of "loose" microcrystals adhered to the first layer. Under scanning electron microscopy (5000×), this layer has a "fuzzy" appearance without clear cleavage planes, suggesting that the microcrystals are present in irregular aggregates or "feathered" crystal structures.

The layer of loose microcrystals, when present, may be left in place or, optionally, may be removed by lightly contacting or brushing the matrix layer with a cotton swab, tissue, cloth, or other soft, non-abrasive material. Indeed, to determine whether such a layer is present, one may simply brush or wipe the matrix layer surface with a cotton swab or tissue. Alternatively, a high pressure stream or jet of an inert gas may be directed at the surface to dislodge and blow away these loose microcrystals. If such a layer is present, brushing, wiping or blowing the matrix surface will change its appearance from a duller, more matte-like surface to a somewhat glossier, more film-like surface as the loose microcrystals are dislodged. For mass production of matrix-bearing MALDI targets, a roller bearing a soft material may, for example, be contacted with and passed over the matrix layer surface. Alternatively, as described above, jets of inert gas may be used. After removal of the loose microcrystalline layer, the well-adhered bottom layer of matrix material remains. It must be emphasized, however, that the loose microcrystals need not be removed and that the layer of loose microcrystals, when present, is still substantially continuous and homogeneous and free of large (i.e. >5–10 $\mu$m) crystals and, therefore, still represents a significant improvement over the prior art.

The remaining variables in the present method do not greatly affect the density of the matrix layer which is deposited on the substrate but, rather, affect the characteristics of that layer. These variables relate to the flow rates of nebulizer and sheath gases, the sheath gas temperature, and the solvents which may be used. As noted above, the present invention depends, in part, upon the discovery that a substantially continuous, homogeneous layer of matrix material may be deposited upon a moving substrate by spraying a solution of matrix material and solvent from a nebulizer which simultaneously discharges a coaxial stream or sheath of gas around the spray. It has been discovered that the sheath of gas both confines or entrains the spray and aids in the partial evaporation of the solvent. It has further been discovered that substantial, if not complete, evaporation of the solvent and a fine spray of matrix material result in a substantially continuous and homogeneous matrix layer substantially free of both voids and large crystals.

The nebulizer gas and sheath gas may be the same or different. It is most convenient that they be the same so that a single source may provide them both. Preferably, the nebulizer gas and sheath gas are chosen from gases or mixtures of gases which are not reactive with either the matrix material or solvent at the temperatures at which the method is conducted. In particular, because it mixes more intimately with the solution of matrix and solvent, the nebulizer gas should be chosen so as to be substantially free of gases which will react with the matrix material and solvent. Thus, in choosing a nebulizer and/or sheath gas, gases which react with many organic materials are disfavored whereas less highly reactive gases, such as nitrogen and the noble gases, are preferred. In addition, the nebulizer and sheath gases should have little or no moisture content to avoid wetting the matrix material. Finally, because the atmosphere is composed of approximately 80% nitrogen gas, even air may be used as the nebulizer and sheath gases. This, however, although economical and convenient, is not recommended because of the moisture content of ordinary air. If air is used, it should be highly filtered and dried.

The flow rates of the nebulizer and sheath gases, like the flow rate of the solution, cannot be specified independent of the bores of the needle tip and nozzle tip. On the other hand, it is possible to specify ranges for the pressure at which the gases are supplied. Thus, for example, the nebulizer and sheath gases may be supplied at a pressure of about 50 to 90 PSIG, more preferably about 60 to 80 PSIG or, most preferably, about 70 PSIG. For the ranges of needle tip diameters and solution flow rates described above, the preferred flow rates of the nebulizer gas are in the range of 20 to 60 $\mu$L/min and the preferred flow rates for the sheath gas are about 1 to 10 L/min. For correspondingly larger or smaller bores for the needle tip and/or sheath tip, correspondingly higher or lower flow rates may be extrapolated from these values.

Although it is not necessary with highly volatile solvents, the sheath gas may be heated relative to the matrix and solvent solution so as to promote evaporation of the solvent. The heated sheath gas transfers heat to the spray in the region of contact between the sheath of gas and the spray. As a result, the temperature of the sheath gas may be used to vary the degree of evaporation of the solvent and, therefore, the amount of solvent reaching the deposition surface of the substrate. As further discussed below, the ability of the sheath gas to heat and promote the evaporation of the matrix solvent is a major advantage of the present method because it allows continuous, homogeneous matrix layers free of both voids and large crystals to be produced even from matrix materials which are soluble only in low-volatility solvents such as water or aqueous solutions. Absent such heating by the sheath gas, matrix solutions including at least one component which is of low-volatility may, as in the prior art, be deposited on the substrate surface in droplets or small "puddles" which dry slowly. Such slowly drying droplets tend to produce large and scattered matrix crystals. Therefore, with solutions containing at least one low-volatility component, the sheath gas should be heated to aid the evaporation of the solution. As an example, assuming the solution is 1:1 (v/v) water-acetonitrile at about 20° C., the sheath gas may be heated to 25° C., 40° C., or even higher but, preferably, to only about 25° C. For solutions having higher proportions of low-volatility solvents, for example 3:7 (v/v) acetonitrile/water or pure water, sheath gas may be heated to substantially higher temperatures such as 60, 75 or even 95° C. (It should be noted that, because the sheath tube surrounds at least part of the needle tube, heating of the sheath gas will transfer some heat to the needle tube and promote the evaporation of some of the solvent in the needle tube. This will aid in the evaporation of the solvent from the spray but, at the same time, may have the deleterious side effect of causing premature evaporation of the solvent within the needle tube. As a result, matrix material may be deposited within the needle tube and cause clogging. Therefore, high sheath gas temperatures are preferably avoided and/or the portion of the needle tube surrounded by the sheath tube should be minimized. It should also be noted that the target or substrate may be heated to aid the evaporation of the solvent. This has not been attempted by the present inventors but is clearly contemplated as another means of preventing the accumulation of droplets or puddles of matrix and solvent solution.)

The nature of the solvent used in the present invention may also be varied. Solvents for matrix materials are well known in the art and may contain one or more components. Typical solvent components include water, acetonitrile (ACN), methanol, ethanol, aqueous trifluoroacetic acid (TFA), acetone, and the like. By varying the proportions of the solvent components, one can alter the evaporation rate of the solvent. For example, a 2:1 (v/v) water-ACN solvent will be less volatile than a 1:1 (v/v) water-ACN solvent which, in turn, will be less volatile than a 1:1 (v/v) ethanol-ACN solvent. The choice of a particular solvent or solvent mix, however, depends largely on the nature of the matrix material. Thus, as is well known in the art, high volatility solvents simply cannot be used with all matrix materials. Because different solvents will have different volatilities, the use of a particular solvent will affect the amount of solvent reaching the substrate. Therefore, the volatility of the solvent will also affect the need for heating of the sheath gas. If even one component of a solvent mix is of low-volatility, sheath gas heating is preferred because this one component may be deposited on the substrate surface and cause the formation of droplets which, in turn, may lead to the formation of large scattered crystals.

The present invention further depends, in part, upon the discovery that the best matrix layers result from a spray in which most if not all of the solvent is evaporated prior to reaching the substrate. That is, the present invention is based in part upon the discovery that (a) if excess solvent is deposited upon the substrate, the solvent and matrix material may, as the solvent evaporates, pool into irregularly spaced droplets which leave unevenly spaced and relatively large matrix crystals on the substrate and (b) if insufficient solvent is deposited upon the substrate, the matrix material may adhere badly and a large portion may be blown away by the nebulizer and sheath gas streams.

In practicing the present method, therefore, it is necessary to adjust the variables described above such that matrix material is deposited with sufficient density but without the excess solvent which leads to the formation of both voids and large crystals. In the prior art methods, it was not possible to achieve these two objectives simultaneously.

Using the methods disclosed herein, however, these objectives may be accomplished. The first five variables discussed above are, as already noted, best used to adjust the density of the matrix material on the substrate. The remaining variables, relating to the nebulizer, sheath gases and solvent choice, may then be used to adjust the amount of solvent reaching the surface. Again, the solvent choice is generally somewhat constrained by the matrix material but, if the solubility of the matrix material permits, more or less volatile solvents or solvent mixtures may be used. More important, the flow rate and temperature of the sheath gas may be used to affect the amount of solvent reaching the substrate with, obviously, higher/lower sheath gas flow rates and higher/lower sheath gas temperatures leading to lesser/greater amounts of solvent reaching the substrate.

The determination as to whether too much solvent is reaching the substrate is performed simply by visual inspection. As the substrate moves forward under the spray, the region exiting the "rear" of the sheath gas envelope should not be covered with droplets or a "puddle" of solution. It is not necessary that the region be dry but, there should not be enough fluid to give the region a glossy, glistening or wet appearance. Rather, the region may appear damp in that it is darker in color than the dried matrix layer but it should still retain a dull, matte-like appearance. If the region exiting the rear of the sheath gas envelope appears damp, the remaining solvent should evaporate in 1 to 2 seconds. A longer drying time suggests an excess of solvent was deposited. That is, there may be a "flash" of solvent on the substrate, appearing briefly as a dark, damp spot, but not a slow-drying drop or puddle. If, even after visually inspecting the matrix layer exiting the sheath gas envelope and adjusting the sheath gas flow rate and temperature accordingly, one still errs in depositing too much solvent with the matrix material, it will be apparent through the presence of a rough surface, spotting, and/or large visible crystals as described above.

The determination as to whether or not too little solvent is being deposited with the matrix material is similarly simple. For some matrix materials (e.g., 2,5-dihydroxybenzoic acid), the matrix material may be deposited essentially dry while still attaining good adhesion to the surface. Thus, with such matrix materials, the region exiting the rear of the sheath gas envelope may appear completely dry but, nonetheless, additional solvent is not needed. For other matrix materials (e.g., α-cyano-4-hydroxycinnamic acid), a little solvent appears necessary in order to produce a well-adhered layer. If too little solvent is deposited, these matrix materials will crystallize in the spray, will strike but not adhere to the surface, and will be blown away by the sheath gas. Again, it is generally apparent by visual inspection when this is the case: the deposition surface will not be altered in appearance and an opaque film of matrix material will not be apparent. Further, the five tests described above may be rapidly used to evaluate whether enough matrix is adhering. In such cases, the flow rate and temperature of the sheath gas or even the rate of movement of the substrate may be adjusted accordingly.

Matrix-Bearing MALDI Targets

In another aspect of the present invention, matrix-bearing MALDI targets are provided. The matrix layers of these targets are distinguishable from the prior art in that they are continuous, homogenous layers of matrix material having an average thickness in excess of 0.7 μm and are substantially free of both voids and large (i.e., >5–10 μm) crystals. In addition, in some embodiments, the matrix-bearing targets of the present invention are distinguishable from the prior art in the design and construction of the target substrate.

The Matrix Layer

The matrix layers of the present invention are superior in quality to those of the prior art in several respects. In particular, they bring together characteristics which could not be found previously in a single matrix layer (e.g., adequate thickness with freedom from large irregularly distributed crystals) and, perhaps more important, possess these characteristics not only in scattered "good spots" but substantially homogeneously over large surface areas.

First, the layers of the present invention are continuous layers substantially free from voids in which the deposition surface is exposed through the layer or in which the layer is insubstantial (i.e. <0.7 μm). This is in contrast to the layers of the prior art which had significant bare patches or voids which necessitated the search for "good spots" with adequate matrix material from which to sample in a mass spectrometer. This is a particularly severe problem in the dried-drop method of the prior art. Even in the present method it is, of course, impossible to guarantee the production of matrix layers which are entirely continuous and entirely free of voids. Simply because of the vagaries of experimental and manufacturing methods, such absolute freedom from voids cannot be guaranteed. Nonetheless, the matrix layers of the present invention may be described as continuous in that they are substantially or essentially free of such voids. By following the methods disclosed herein, such continuous layers can be consistently produced.

Second, the matrix layers of the present invention are substantially free of large (i.e., >5–10 μm) crystals. Again, the irregularity of the size, shape and distribution of such crystals is a serious problem in the prior art methods of dried-drop matrix deposition. As low-volatility solvents slowly evaporate, such crystals inevitably form and, when subjected to a laser pulse, yield irreproducible signals. Because the present method allows for the control of the amount of solvent reaching the deposition surface with the matrix material, it is now possible to produce matrix layers which are substantially free of such large crystals but, rather, which consist of a continuous layer of microcrystals. Again, an absolute absence of large crystals cannot be guaranteed, but the present method allows the consistent production of continuous matrix layers which are substantially or essentially free of such large crystals.

Third, the matrix layers of the present invention are sufficiently thick that, when analyte is placed on the matrix layer in a typical solution, the solvent deposited with the analyte will not be sufficient to dissolve the entire matrix layer but, rather, only the top layer. This is important to ensure that the analyte is well embedded in the matrix material for laser desorption/ionization. In the recently disclosed fast evaporation technique using, for example, acetone as a solvent, the layer of matrix material which is deposited is exceedingly thin even using a saturated solution of matrix material in the solvent. The iridescence or interference fringe of such matrix layers indicates that they are thinner than the wavelengths of visible light (i.e., <0.7 μm). In contrast, the matrix layers of the present invention are thicker than this, typically averaging from 1–50 μm in thickness, and most commonly from 20–50 μm in thickness. Using the methods of the present invention, including multiple passes of the matrix solution spray over a given area of substrate, layers of any desired thickness may be deposited. Therefore, the present invention specifically provides for matrix layers of about 20, 30, 40, 50 or even 60 μm in thickness which, nonetheless, are free of large crystals and which comprise a continuous, homogeneous layer. Such thicker layers are much better suited to embedding an analyte for MALDI mass spectrometry.

Finally, it should be noted that the "good spots" of the prior art matrix layers, when present at all, may possess the characteristics of some of the matrix layers of the present invention but only on a very small scale. That is, randomly, the prior art matrix layers may have possessed "spots" free of large crystals and greater than 0.7 $\mu$m in thickness. The present invention, however, provides large matrix layers in which substantially every spot is a "good spot." Thus, the present invention provides matrix layers in excess of 10,000 $\mu m^2$ which are continuous, substantially free of large matrix crystals and which average in thickness more than 0.7 $\mu$m. Indeed, according to the purpose for which the matrix layers are to be used, the present invention provides for such continuous matrix layers of almost arbitrary size. Thus, matrix layers with the above-described characteristics may be produced at sizes greater than 1 $mm^2$ (for use in, e.g., spotting individual samples), greater than 10 $mm^2$ (for use in, e.g., multiple spotting), greater than 100 $mm^2$ (for use, e.g., in depositing HPLC effluents) or even greater in area (for use, e.g., in mass production of pre-formed targets or in diagnostic laboratories performing high through-put assays).

Deposition Surface

The deposition surface of the present invention has few required characteristics. The surface may be of any shape which is compatible with the spectrometer with which it is intended to be used. Although the surface may be concave, convex, spherical, or arbitrarily shaped, it is expected that substantially planar surfaces will be compatible with the greatest number of mass spectrometers. In particular, it is expected that planar targets which are substantially circular or rectangular will be most useful. In addition, in order to facilitate convenient, economical, and homogeneous application of the matrix material to the surface, it is preferred that the deposition surface have a simple geometry. Again, substantially planar or regularly curved (e.g. spherical, cylindrical) surfaces are preferred.

Although etched or roughened surfaces have been used in the art and may be employed in the present invention, it is preferred that the deposition surface be substantially smooth. Smooth surfaces are more easily and thoroughly cleaned between uses and, therefore, intersample contamination between uses is reduced. By a substantially smooth surface is meant one whose topography has a RMS of <1 $\mu$m. Preferred surfaces are smooth surfaces formed by metals, crystals or polymers and, in particular, polishable metals and crystals. Suitable metals include gold, silver, chrome, nickel, aluminum, and stainless steel. Suitable crystals include germanium and quartz.

It is also preferable, although not necessary, that the deposition surface be composed of a conductive or semi-conductive material to avoid the accumulation of charge at the point of sample ionization. Thus, for this reason, conductive metals and conductive or semi-conductive crystals are particularly preferred as deposition surface materials.

Finally, as will be obvious to one of skill in the art, the deposition surface material should be inert, non-reactive, and substantially insoluble with the matrix materials and solvents typically used in MALDI. Thus, for example, the alkali earth metals are not suitable surface materials.

Target Construction

Currently, a variety of targets is available for use in MALDI mass spectrometers and many of the targets are adapted for use in particular machines. The targets are removable so that the sample may be applied outside of the spectrometer and so that the target may be more easily cleaned. The substrate of the target is preferably of a rigid material. Most currently available targets consist of stainless steel or other metals but this is not necessary. These targets are generally planar and, when viewed from above, either circular or rectangular in shape. An alternative design employs a carousel with holes adapted to receive a multiplicity of cylindrical targets. In these models, the cylinders are inserted into the carousel perpendicularly and the matrix and sample are deposited on the ends of the cylinders. The matrix-bearing targets of the present invention may be produced from any of these prior art targets.

In a particularly preferred embodiment of the present invention, the matrix-bearing targets are designed so as to be placed upon and secured to the prior art targets which are used with current MALDI mass spectrometers. That is, the matrix-bearing target is constructed so as to be sufficiently-thin that it may be overlaid on the existing targets. Because of the fixed dimensions of most current mass spectrometers, such targets are preferably less than 2 mm and more preferably less than 1 mm. In a most preferred embodiment, the matrix-bearing target is less than 0.5 mm in thickness. Because, in this set of embodiments, it is desired that the matrix-bearing targets of the present invention be placed upon and secured to existing MALDI targets, in another embodiment the targets are provided with a thin layer of an adhesive material on the bottom surface of the substrate to effect attachment.

In one set of embodiments, the substrate may consist of a single material. When a single material is used, that material will define the deposition surface and must also provide sufficient rigidity for normal handling of the target. As noted above, metals and particularly polishable metals are preferred materials for forming the deposition surface. When a metal is used as the sole material for forming the substrate, the substrate may be molded from molten metal but, for obvious economic reasons, is preferably die-cut from sheets of metal. In the most preferred embodiments, the substrate is die-cut from stainless steel sheet metal with a thickness of less than 2 mm, 1 mm, or 0.5 mm.

Alternatively, the substrates of the present invention may be composed of one or more different materials forming one or more layers. The "top" layer of the substrate will define the deposition surface and is referred to herein as the deposition layer. The material forming the deposition layer will preferably have the characteristics described above for the deposition surface, in particular smoothness and conductivity. The "bottom" layer of the substrate may be composed of one or more materials in one or more layers which, collectively, will be referred to herein as the base layer. As this layer of the substrate does not define the deposition surface, its sole function is to provide rigidity to the target and support for the deposition layer. The bottom layer may, therefore, be composed of any material capable of providing this rigidity and, in particular, may be composed of metals, glass, or relatively inflexible plastics. Again, an adhesive layer may be applied to the bottom surface.

In one preferred embodiment, the deposition layer is a metal foil which is bound to a metallic, glass, or plastic base layer. In another preferred embodiment, the deposition layer is a metal which has been deposited onto the base layer to form a smooth, thin deposition layer. The deposition layer may be bound to the base layer in any of a variety of means known in the art. As will be obvious to one of skill in the art, depending upon the manner in which the deposition layer is formed, the geometry and smoothness of the base layer may affect the smoothness of the deposition layer and determine the overall geometry of the target. Therefore, it is preferred that the surface of the base layer to which the deposition layer is bound should also be smooth and that the geometry of the base layer provide a substantially planar surface to which the deposition layer may be bound.

Special Utilities

The matrix-bearing targets of the present invention, as noted above, have several advantages over the prior art in terms of continuity, freedom from large crystals, and thickness. In addition, however, they are particularly well-suited for mass-production and storage and for on-line deposition of materials eluting from HPLC.

Typically in MALDI, the matrix solution and analyte solution either are mixed prior to deposition or are deposited nearly simultaneously. In the present method, the matrix-bearing target is pre-formed and, at some subsequent point, analyte in solution is applied to the matrix layer surface. The present inventors have found that the matrix layers of the present invention are stable for long periods (e.g., up to six months for α-cyano-4-hydroxycinnamic acid matrix layers) without the need for refrigeration or controlled atmospheres. Therefore, they may be prepared in large quantities well in advance of use. In particular, it is contemplated that pre-formed matrix-bearing targets for MALDI mass spectrometry may be mass produced and sold commercially. For such purposes, the thin substrate layers described above may be particularly useful as they can be made cheaply enough to be disposable and can be affixed to the tops of the existing targets of various different models of mass spectrometers. Thus, researchers or diagnostic laboratories may be freed from the need to produce fresh matrix layers but, rather, can purchase pre-formed matrix-bearing targets with qualities superior to those of the prior art.

A special utility of particular interest involves HPLC. In U.S. Pat. No. 4,843,243 ("the '243 patent"), a method was disclosed for continuously collecting chromatographic effluent on a target for use in spectroscopy or spectrometry. This patent, however, was filed before the advent of MALDI mass spectrometry. Because the solvent mix changes continuously during HPLC and because it would be difficult to simultaneously deposit a matrix layer along with HPLC effluent, in-line HPLC sample deposition has not previously been amenable to MALDI mass spectrometric analysis. Using the pre-formed matrix-bearing targets of the present invention in conjunction with a slightly modified version of the method of the '243 patent, however, HPLC samples may be continuously deposited on the matrix layer surfaces and then the target may be placed in a mass spectrometer for analysis. Whereas, the '243 patent teaches that the samples should be deposited essentially free of solvent to prevent diffusion on the target surface, for use with the matrix-bearing targets of the present invention the sample should be deposited with sufficient solvent to dissolve the top region of the matrix layer and to allow embedding of the analyte in the matrix as the solvent evaporates. As will be obvious to one of ordinary skill, however, the amount of solvent deposited with the HPLC analytes should not be so great as to completely dissolve the matrix layer down to the deposition surface or to allow diffusion of the analyte bands.

EXAMPLES

The following examples are provided to illustrate the methods and products of the present invention with particular choices for the several components and particular values for the several variables described above. As described above, many variations on these particular examples are possible and, therefore, the examples are merely illustrative and not limiting of the present invention.

Example 1

A matrix layer of α-cyano-4-hydroxycinnamic acid ("αCCA") was deposited onto the polished (<1 μm RMS) end face of a constantly rotating cylindrical stainless steel target via the methods described above. The solution was 5 g/L of αCCA in 1:1 (v/v) acetonitrile and water. The solution was pumped into an LC Transform 101 (Lab Connections, Inc., Marlborough, Mass.) by a syringe pump operated at a flow rate of 20 μL/min. A nitrogen tank with a supply pressure of 70 PSIG was used to provide both the nebulizer and sheath gas flows, which were 40 mL/min and 5.5 L/min respectively. The sheath gas was heated to 25° C. and no target heating was used. The target was rotated at 50° per minute (~10 mm/min) and the nebulizer nozzle was located 11.5 mm above the horizontal target surface. The resultant matrix layer was an annular track 6 mm wide with a center radius of 11 mm.

These spray parameters resulted in a "flash" or short-lived, very thin zone of solvent several millimeters in diameter formed on the target directly under the spray nozzle. The matrix film grew from the edge of this zone as that portion of the target rotated out from under the spray area. By controlling the rate of drying at this interface between the dried matrix film and the flash zone, and minimizing perturbations to the size of the zone, the spray parameters listed above produced a homogeneous matrix film. This film was composed of two layers: a light green bottom layer of ~10 μm in thickness very well adhered to the stainless steel surface of the target, and a loose, powdery, top layer, darker green in appearance although equally homogeneous. This top layer was 2–3 times thicker than the bottom layer. It was removed by gentle wiping with a cotton swab to expose the lower layer, onto which samples were spotted for MALDI analysis.

The principle benefits that this matrix film provided over the standard MALDI sample preparation derived from its much greater homogeneity. Searching for a spot that provided a strong analyte-ion signal was essentially unnecessary on the matrix film where all spots were equivalent in this regard. Because of the repeatability of this signal, it was much easier to determine the laser intensity corresponding to the threshold of ion production, and to subsequently acquire data near this threshold. Due to the nature of the MALDI process, this ability often resulted in mass spectra which displayed larger signal/noise ratios and/or greater resolution than those spectra obtained from conventionally prepared samples.

Example 2

A matrix film of 2,5-dihydroxybenzoic acid (DHB) was deposited onto a target identical to that used for αCCA in Example 1. The resulting matrix film was again annular in shape with a width of ~4 mm and center radius of 11 mm.

A solution of DHB at one-half saturation (~10 g/L) in water was pumped into the LC Transform 101 by a syringe pump operated at a flow rate of 30 μL/min. The nebulizer and sheath gas flows were 40 mL/min and 4.5 L/min respectively, both supplied from a 70 PSIG nitrogen tank. The sheath gas was heated to 95° C. and no target heating was used. The target was rotated at 50° per minute and the nebulizer nozzle was located 11.5 mm above the horizontal target surface.

In contrast to Example 1, these spray parameters deposited the matrix film in a completely dry manner. This film was composed of a single layer that was extremely well bonded to the target surface. Its thickness was roughly equal to the thickness of the combination of top and bottom layers of the film in Example 1. It was greyish-white in color and once again extremely homogeneous. Samples were spotted directly onto the matrix film as sprayed for MALDI analysis. The differences between this film and the corresponding standard MALDI preparation were analogous to those experienced in Example 1 but even more pronounced, probably due in part to the large irregularities inherent in the samples produced by the standard preparation method.

Example 3

A matrix film of 3-hydroxypicolinc acid (HPA) was deposited onto a target identical to that used in Example 1. The resulting annular matrix film had a width of ~4 mm and a center radius of 11 mm.

A solution of HPA at one-third saturation in 1:1 (v/v) acetonitrile/water (~20 g/L) was pumped into the LC Transform 101 by a syringe pump operated at a flow rate of 33 μL/min. The nebulizer and sheath gas flows were 40 mL/min and 5.5 L/min respectively, both supplied from a 70 PSIG nitrogen tank. The sheath gas was heated to 40° C. and no target heating was used. The target was rotated at 50° per minute and the nebulizer nozzle was located 11.5 mm above the horizontal target surface.

The spray parameters listed above deposited the matrix film in an almost completely dry manner. A barely perceptible flash of solvent accompanied this deposition. The film was a single layer, greyish-white in color like the film in Example 2, although more diffuse at the (radial) edges, with some "overspray." Once again, it was extremely homogeneous and very well adhered to the surface of the target. Surprisingly, the MALDI performance of this film was not significantly better than that of the standard preparation method with the single analyte tested. Its improved appearance, however, suggests that further testing is warranted.

Example 4

A matrix film of sinapinic acid (SA) was deposited onto a target identical to that used in Example 1. The resulting annular matrix film had a width of ~5 mm and a center radius of 11 mm.

A solution of sinnapic acid (SA) at one-third saturation in 3:7 (v/v) acetonitrile/water was pumped into the LC Transform 101 by a syringe pump operated at a flow rate of 33 μL/min. The nebulizer and sheath gas flows were 40 mL/min and 3 L/min respectively, both supplied from a 70 PSIG nitrogen tank. The sheath gas was heated to 75° C. and no target heating was used. The target was rotated at 50° per minute and the nebulizer nozzle was located 11.5 mm above the horizontal target surface.

The spray parameters listed above deposited the matrix film in a slightly wetter manner than those previously described. This film appeared as a white, powdery single layer. Unlike all of the previous examples, it was not well adhered to the surface of the target. Although homogeneous, it did not have quite the opacity of the other films, being a "loose" powder. The MALDI performance of this film was not improved over the prior art, reflecting perhaps on the "wetter" flash and suggesting the need for modifications to the parameters above.

Example 5

A matrix film of 2-(4-hydroxyphenylazo)-benzoic acid (HABA) was deposited onto a target identical to that used in Example 1. The resulting annular matrix film had a width of ~2.5 mm and a center radius of 11 mm.

A solution of HABA at one-third saturation in 1:1 (v/v) acetonitrile/water was pumped into the LC Transform 101 by a syringe pump operated at a flow rate of 66 μL/min. The nebulizer and sheath gas flows were 40 mL/min and 5.5 L/min respectively, both supplied from a 70 PSIG nitrogen tank. The sheath gas was heated to 60° C. and no target heating was used. The target was rotated at 50° per minute and the nebulizer nozzle was located 7.5 mm above the horizontal target surface.

The spray parameters listed deposited the matrix film in a wet manner. This film was bright orange in color and was composed of two layers analogous to the film in Example 1, although not quite as homogeneous. As in the case of Example 1, the bottom layer was very well adhered to the surface of the target, while the top layer was a loose powder. This top layer was removed by wiping with a cotton swab and samples applied to the lower layer for MALDI analysis. Unlike Example 1, the MALDI performance of this film was not improvement over the prior art but, as in Example 4, the presence of excess solvent suggests the need to modify the deposition parameters.

Example 6

A matrix film of 7-amino-4-methyl coumarin (AMC) was deposited onto a target identical to that used in Example 1. The resulting annular matrix film had a width of ~4 mm and a center radius of 11 mm.

A solution of AMC at one-third saturation in 1:1 (v/v) acetonitrile/water was pumped into the LC Transform 101 by a syringe pump operated at a flow rate of 33 μL/min. The nebulizer and sheath gas flows were 40 mL/min and 3.8 L/min respectively, both supplied from a 70 PSIG nitrogen tank. The sheath gas was heated to 25° C. and no target heating was used. The target was rotated at 50° per minute and the nebulizer nozzle was located 11.5 mm above the horizontal target surface.

The spray parameters listed above deposited the matrix film in a wet manner. This film had the appearance of the film in Example 4 except that it was not quite as white. Unlike the SA film however, it was composed of two layers, a well adhered bottom layer and a very thin, powdery top layer. This top layer constituted only a small fraction of the total film, unlike the previous two-layer examples. The top layer was removed by wiping with a cotton swab, exposing the very homogeneous bottom layer for MALDI samples. The MALDI performance of this film was fair. The wetness of the flash suggests that improvement may be obtained with further modifications of the deposition parameters.

DEFINITIONS

As used herein, the term "MALDI matrix material" means a compound, whether in solution or solid, which may be used to form a matrix for use in MALDI mass spectrometry. For MALDI, the analyte must be embedded in a large excess of molecules which are well-absorbing at the wavelength at which the laser emits. These matrix molecules are generally small, solid organic compounds, mainly acids. Appropriate matrix materials for each type of laser used in MALDI are well known in the art and the term "MALDI matrix material" will be clearly understood by one of skill in the art. Without limiting the present invention, examples of commonly used matrix materials include sinapinic acid, α-cyano-4-hydroxycinnamic acid, 2,5-dihydroxybenzoic acid, 3-hydroxypicolinic acid, 5-(trifluoro-methyl)uracil, caffeic acid, succinic acid, anthranilic acid, 3-aminopyrazine-2-carboxylic acid and ferulic acid?

As used herein, the term "matrix layer" means matrix material which is adhered to a deposition surface and which, at its boundaries, is at least 0.7 μm in thickness. The boundaries of a matrix layer may be surrounded by additional matrix material adhered to the deposition surface but which is less than 0.7 μm in thickness. This material does not constitute part of the matrix layer. That is, the matrix layers of the present invention may be surrounded or bordered by additional matrix material which is deposited with decreasing density around the matrix layer and which forms a "fringe" of decreasing thickness about the edges of the matrix layer. (When spraying a matrix onto a target as in the methods described above, some of the spray will often escape the sheath of gas and spread outward from the center of the spray producing a matrix material fringe with density decreasing away from the center of the spray or track.) As used herein, the term "matrix layer" does not include this boundary or fringe material but, rather, is limited to the layer of matrix material which is bounded by matrix material at least 0.7 μm in thickness. The matrix material within this boundary may be of varying thickness and may include areas in which the thickness is less than 0.7 μm and may even include bare spots or voids in which the deposition surface is exposed through the layer. The average thickness, however, exceeds 0.7 μm.

As used herein, the term "substantially continuous matrix layer," means a matrix layer on a deposition surface wherein the layer is substantially free from bare spots or voids at which the deposition surface is exposed through the layer or at which the matrix layer is <0.7 μm in thickness. In particular, a substantially continuous matrix layer means one in which <5% of the deposition surface area bounded by the matrix layer is exposed or covered by a matrix layer <0.7 μm in thickness. As used herein, the term "essentially continuous matrix layer" means a substantially continuous matrix layer in which <1% of the deposition surface area bounded by the matrix layer is exposed or covered by a matrix layer <0.7 μm in thickness.

As used herein, when referring to a matrix layer, the term "substantially free of matrix material crystals having any dimension in excess of x μm" means a matrix layer in which <10% of the deposition surface area bounded by the matrix layer is covered by such crystals. Similarly, in the same context, a matrix layer "essentially free" of such crystals means a matrix layer in which <5% of the deposition surface area bounded by the matrix layer is covered by such crystals.

As used herein, the term "low-volatility solvent" means a solvent which, at standard pressure (i.e. 1 atm), has a boiling point of >65° C. and, preferably, >70° C. For a solvent which is a mixture of components, the term "low-volatility solvent" means a solvent in which at least 90% (v/v) of the components have, at standard pressure, boiling points of >65° C. and, preferably, >70° C.

We claim:

1. A method of forming a continuous matrix-bearing target having a matrix aver with an average thickness in excess of 0.7 μm and being substantially free of matrix crystals having any dimension in excess of 10 μm for matrix-assisted laser desorption/ionization mass spectrometry comprising:

directing at a deposition surface a spray of a solution of a matrix-assisted laser desorption/ionization matrix material dissolved in a solvent;

simultaneously directing at said surface a stream of non-reactive gas forming a substantially coaxial sheath enveloping said spray; and causing said surface and said spray to move relative to one another forming a continuous matrix layer of said matrix material having an average thickness in excess of 0.7 μm and being substantially free of matrix crystals having any dimension in excess of 10 μm the matrix layer being deposited on said surface.

2. A method as in claim 1 wherein said matrix material is selected from the group consisting of sinapinic acid, α-cyano-4-hydroxycinnamic acid, 2,5-dihydroxybenzoic acid, 3-hydroxypicolinic acid, 5-(trifluoro-methyl)uracil, caffeic acid, succinic acid, anthranilic acid, 3-aminopyrazine-2-carboxylic acid, ferulic acid, 7-amino-4-methyl-coumarin, 2,4,6-trihydroxy acetophenone, and 2-(4-hydroxyphenylazo)-benzoic acid.

3. A method as in claim 1 wherein said non-reactive gas is selected from the group consisting of $N_2$, the noble gases, and dried air.

4. A method as in claim 1 wherein said non-reactive gas is heated relative to said solution.

5. A method as in claim 1 further comprising the steps of allowing said matrix material to crystallize on said surface and contacting said matrix material with a non-abrasive material to remove a layer of loose microcrystals.

* * * * *